US010415255B2

(12) United States Patent
Kuo et al.

(10) Patent No.: US 10,415,255 B2
(45) Date of Patent: Sep. 17, 2019

(54) HANDRAIL AND RAILING ASSEMBLY

(71) Applicants: Chingyao Kuo, Luzhou (TW); Norman William Liefke, Surrey (CA)

(72) Inventors: Chingyao Kuo, Luzhou (TW); Norman William Liefke, Surrey (CA)

( * ) Notice: Subject to any disclaimer, the term of this patent is extended or adjusted under 35 U.S.C. 154(b) by 295 days.

(21) Appl. No.: 15/451,452

(22) Filed: Mar. 7, 2017

(65) Prior Publication Data

US 2018/0258648 A1 Sep. 13, 2018

(51) Int. Cl.
*E04F 11/18* (2006.01)

(52) U.S. Cl.
CPC ..... *E04F 11/1804* (2013.01); *E04F 11/1808* (2013.01); *E04F 11/1838* (2013.01); *E04F 2011/1889* (2013.01)

(58) Field of Classification Search
CPC ..... E04F 11/1804; E04F 11/1808; E04F 11/1838; E04F 11/1802; E04F 11/1836; E04F 11/184; E04H 17/1421
See application file for complete search history.

(56) References Cited

U.S. PATENT DOCUMENTS 2,715,513 A * 8/1955 Kools ..... E04F 11/1834 256/21
3,433,460 A * 3/1969 Kusel ..... E04F 11/1804 248/251
3,733,055 A * 5/1973 Hughes, Jr. ..... E04F 11/184 256/21
4,220,316 A * 9/1980 Naka ..... E04F 11/1836 256/1
6,565,069 B2 * 5/2003 Morris ..... E04F 11/1836 256/65.15
8,342,771 B2 * 1/2013 Goad ..... A47K 17/022 211/123
8,356,802 B2 * 1/2013 Reich ..... E04F 11/1836 256/65.09
8,757,566 B2 * 6/2014 Nash ..... E04F 11/1804 248/201
2003/0151040 A1 * 8/2003 Safael ..... E04F 11/1836 256/59
2008/0078904 A1 * 4/2008 Trimble ..... E04F 11/1804 248/251
2008/0209853 A1 * 9/2008 Hull ..... E04F 11/1838 52/832
2014/0054530 A1 * 2/2014 Petta ..... E04H 17/1421 256/67

(Continued)

FOREIGN PATENT DOCUMENTS

EP 2163703 A1 * 3/2010 ..... E04F 11/1836
EP 3196380 A1 * 7/2017 ..... B22F 3/105

(Continued)

*Primary Examiner* — Jonathan P Masinick
(74) *Attorney, Agent, or Firm* — Bacon & Thomas, PLLC

(57) ABSTRACT

Disclosed is a handrail and railing assembly, which is made up of a handrail, a plurality of support frames, a movable corner, connecting sleeves and a corner connecting rod; wherein the handrail is connected by a plurality of handrail units and connecting sleeves, and connected by a movable corner or corner connecting rod at a corner; the spaced support frames are provided to hold the handrail. The handrail and railing assembly meets the strength requirements of different sites and can be adjusted according to the on-site installers.

4 Claims, 5 Drawing Sheets

(56) References Cited

U.S. PATENT DOCUMENTS

| | | | | |
|---|---|---|---|---|
| 2014/0097394 | A1* | 4/2014 | Hsieh | E04F 11/1804 256/65.15 |
| 2014/0199112 | A1* | 7/2014 | Milner | E04F 11/1834 403/72 |
| 2015/0252569 | A1* | 9/2015 | Warshaw | E04F 11/184 403/205 |
| 2015/0259926 | A1* | 9/2015 | Chang | E04F 11/1836 256/65.01 |
| 2018/0179781 | A1* | 6/2018 | Munro | E04H 17/1421 |

FOREIGN PATENT DOCUMENTS

| | | | | |
|---|---|---|---|---|
| FR | 2930606 | A1 * | 10/2009 | E04F 11/1836 |
| FR | 2983503 | A1 * | 6/2013 | E04F 11/1834 |
| WO | WO-2016054676 | A1 * | 4/2016 | E04G 5/14 |

* cited by examiner

HANDRAIL AND RAILING ASSEMBLY

BACKGROUND OF THE INVENTION

1. Field of the Invention

The present invention relates to a handrail and railing assembly, particularly to a handrail and railing assembly which can be quickly assembled by a handrail, a movable corner, a corner connecting rod and support frames and adjusted according to on-site environment.

2. Description of the Related Art

With the development of civilization and economy, the government and the community have begun to pay more attention to those who are inconvenienced by aging, illness or accident For people with reduced mobility, apart from establishing a sound health care system, there is a need to provide ancillary facilities to facilitate their operation. For example, in general public places, there will be more barrier-free access to persons with reduced mobility through wheelchairs or slow action into/out of the building. The setting of handrails is even more important for people who are slow or physically weak.

Conventional handrails on the railings are mostly fixed by welding. Although the welding method is easy to apply with the advantage of stability, arms cannot be adjusted according to user's height and physical condition after the completion of welding. Also, assembly or replacement is quite time-consuming, more likely to cause waste, resulting in environmental issues.

In view of the aforementioned shortcomings with regards to the wearable device, after a long period of research in conjunction with improvement on the aforementioned deficiency, the present invention is eventually presented by the inventor.

SUMMARY OF THE INVENTION

Accordingly, it is a major objective of the present invention to provide a handrail and railing assembly, such that each of the handrails can be installed onto the railings quickly according to site requirements.

It is another objective of the present invention to provide a handrail and railing assembly, which is assembled by a handrail, a plurality of support frames, a movable corner, and a corner connecting rod; the handrail is constructed by connecting a plurality of handrail units and connecting sleeves, and is able to extend at the corner through angle adjustment by the movable corner. The plurality of support frames provides stable support for the handrail. Overall, the handrail and railing assembly is easy to implement, adjust, and replace.

It is a further objective of the present invention to provide a handrail and railing assembly, wherein the support frame includes a holder, a U-shaped seat and a bracket. The fixed seat is fixed to the railing post or thin tube; the U-shaped seat is connected to the fixed seat; one end of the bracket can be connected to the U-shaped seat for angle adjustment, and the top of the bracket is connected to the handrail by a screw to provide a stable support for the handrail.

It is a further objective of the present invention to provide a handrail and railing assembly, wherein the movable corner includes a female movable seat, a male movable seat and a latch. The female movable seat is connected to the male movable seat through a bolt. The opposite end of the female movable seat and the male movable seat is a cannula. The inside of the cannula is provided with latching projection boards spaced along the edge of the pipe, allowing the female movable seat and the male movable seat to be connected to the handrail units by the latching projection boards and to adjust the bend angle of the handrail appropriately.

It is a further objective of the present invention to provide a handrail and railing assembly, in which the female movable seat and the male movable seat can be folded or unfolded in the range of 0-90° to accommodate different angles of stitching and provide a more flexible extension angle for the handrail.

It is still another objective of the present invention to provide a handrail and railing assembly, wherein the outer surface of the connecting sleeve body is provided with a bump, and sleeved with a collar. A rib is provided inside the collar. The rib has a slightly larger gap than the bump. It is easy for the sleeve body to connect with handrail units, which saves significant space for packaging, shipping and assembly.

It is still another objective of the present invention to provide a handrail and railing assembly, which is made of lightweight aluminum alloy.

It is still another objective of the present invention to provide a handrail and railing assembly, in which the beginning and end of the handrail can be fitted with an end cap to prevent rainwater from penetrating into the handrail, causing the handrail to rust.

It is still another objective of the present invention to provide a handrail and railing assembly, in which the beginning and end of the handrail can be fitted with a wall-connecting base, providing the overall seal and beautification.

The objectives, shape, configuration, device characteristics and effectiveness of the present invention will be described in detail hereafter with reference to the following embodiments in conjunction with the accompanying drawings.

DETAILED DESCRIPTION OF THE PREFERRED EMBODIMENT

Figure 1:
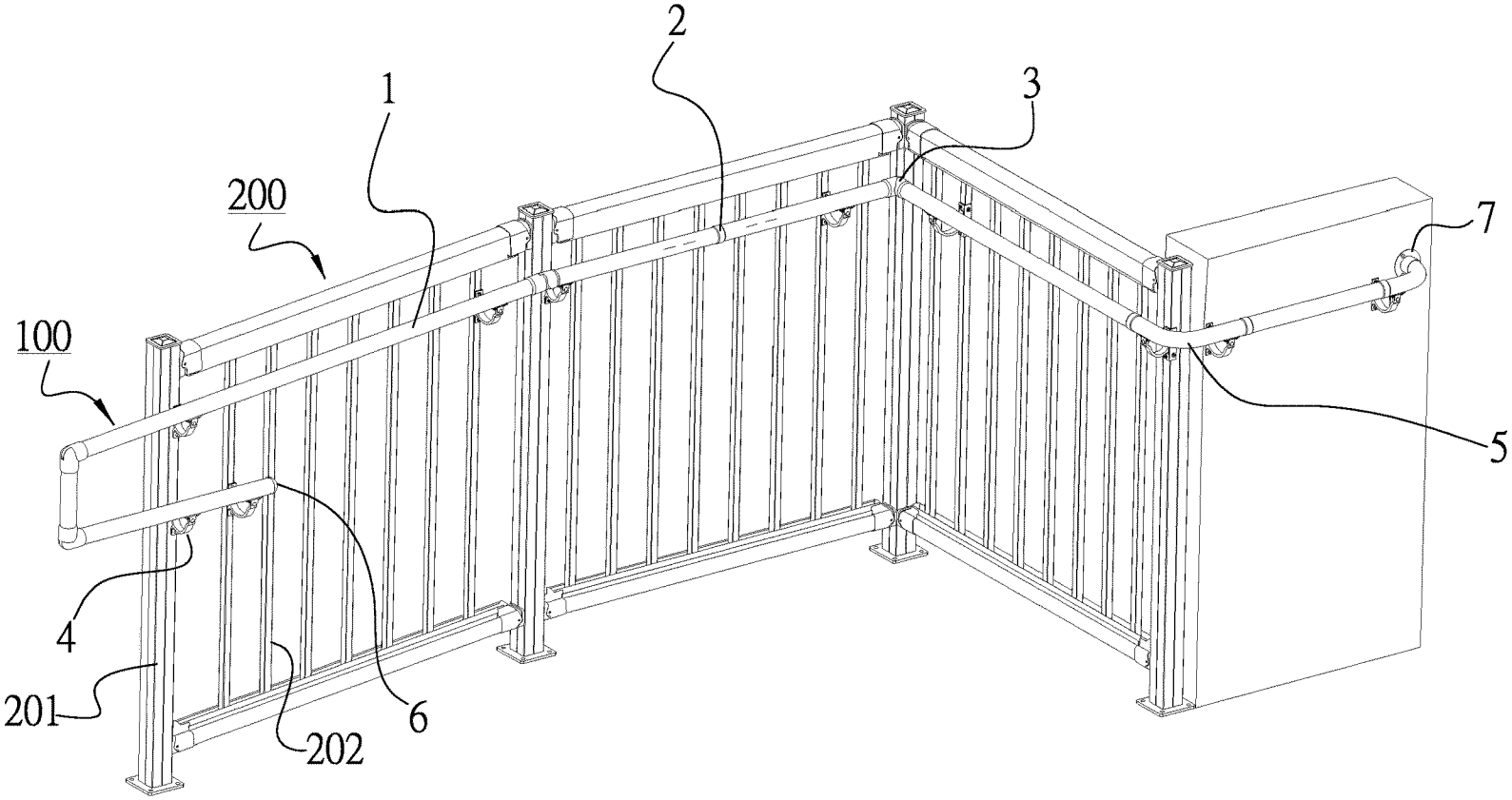
FIG. 1 is an assembled perspective view of a handrail and railing assembly in the present invention.

As shown in FIG. 1, a handrail and railing assembly 100 is fixed to the railing 200 laterally. The handrail and railing assembly 100 includes: a handrail 1, a connecting sleeve 2, a movable corner 3, a support frame 4, and a corner connecting rod 5. The corner connecting rod 5 is installed at the right-angle corner, such that the handrail lean be extended and bent at a 90°.

Figure 2:
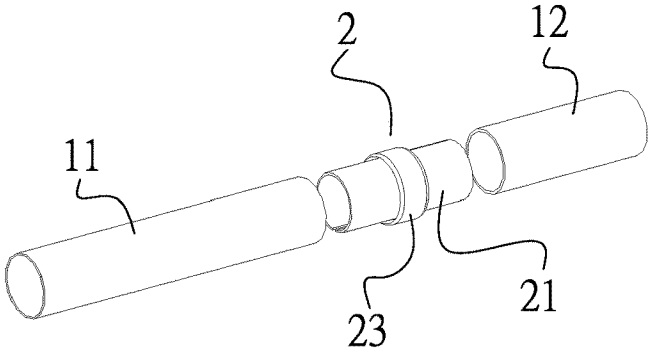
FIG. 2 is a perspective view showing handrail units and a connecting sleeve of the handrail and railing assembly in the present invention.
Figure 3:
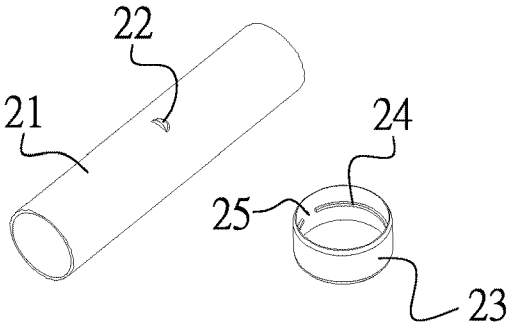
FIG. 3 is a perspective view showing a connecting sleeve and a collar of the handrail and railing assembly in the present invention.

Please refer to FIGS. 2 and 3. The handrail 1 is constructed by connecting a plurality of handrail units 11, 12 . . . sequentially. Each of the handrail units 11, 12 is connected by a connecting sleeve 2. The connecting sleeve 2 is provided with a sleeve body 21. The outer surface of the sleeve body 21 is provided with a bump 22 as well as a collar 23. A rib 24 is provided inside the collar 23. The rib 24 has a slightly larger gap 25 than the bump 22. Whereby, when the collar 23 is fitted outside the sleeve body 21, the gap 25 on the rib 24 is opposite to that of the bump 22, the collar 23 can slide left and right on the sleeve body 21, and can adjust the position of the connection between the handrail units 11, 12 on two sides and the sleeve body 21. When the position of the handrail units 11, 12 and the sleeve body 21 is determined, the collar 23 is rotated so that the gap 25 on the rib 24 deviates from the bump 22, and the collar 23 cannot slide left and right on the sleeve body 21.

Figure 5:
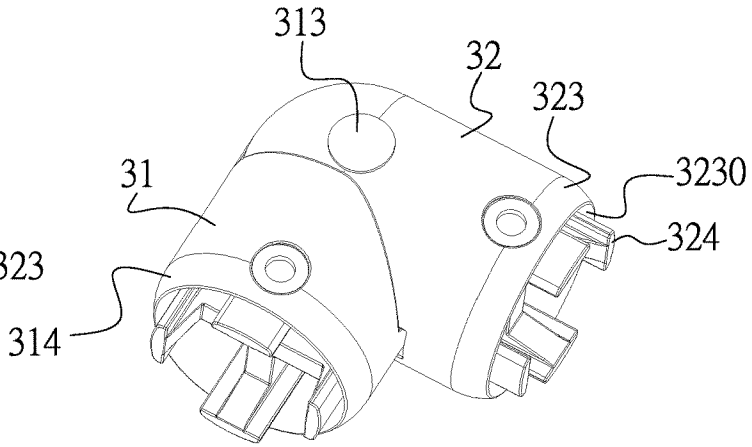
FIG. 5 is an assembled perspective view showing the movable corner of the handrail and railing assembly in the present invention.
Figure 4:
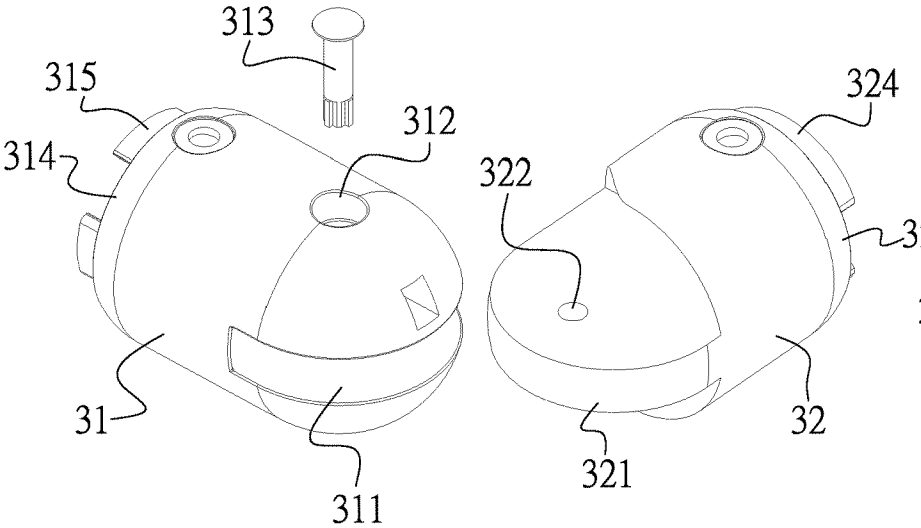
FIG. 4 is an exploded perspective view showing a movable corner of the handrail and railing assembly in the present invention.

The movable corner 3, located at the corner of the handrail 1, enables the handrail units 11, 12 . . . to rotate relative to each other. Please refer to FIGS. 4 and 5. The movable corner 3 includes: a female movable seat 31 and a male movable seat 32. One end of the female movable seat 31 is provided with a lateral kerf 311, and a radial through hole 312 is provided relative to above the lateral kerf 311 for locking into a screw bolt 313. The opposite end of the female movable seat 31 is a cannula 314. A plurality of spaced latching projection boards 315 are provided along the inside of the cannula 314.

As shown, one end of the ale movable seat 32 is provided with a plug portion 321. The plug portion 321 is a thin plate, which can be inserted into the female movable seat 31 inside the kerf 311. The surface of the plug portion 321 is provided with a through hole 322. When it is inserted into the inside of the kerf 311 of the female movable seat 31, its through hole 322 is in communication with the radial through hole 312 of the female movable seat 31. That is, by the screw bolt 313 passing through the through hole 322 and the radial through hole 312, the female movable seat 31 and the male movable seat 32 are assembled to each other. The opposite end of the male movable seat 32 is also a cannula 323. A plurality of spaced latching projection boards 324 are arranged along the inside of the cannula 323.

Accordingly, the female movable seat 31 and the male movable seat 32, through the screw bolt 313 to pass therein, form the movable corner 3 that can be rotated relative to any angle. There is an interspace 3230 between the latching projection boards 324 at one end of the female movable seat 31 and the male movable seat and the cannula 323, when the handrail units 11, 12 are sleeved from the outside into the interspace 3230, it is right located between the latching projection boards 324 and the cannula 323. Therefore, the handrail units 11, 12 . . . can be fixed by the elastic force of the latching projection boards 324 after being inserted from the cannula 323.

As shown, since the female movable seat 31 and the male movable seat 32 are inserted into the kerf 311 of the female movable seat 31 through the plug portion 321 of the male movable seat 32, and then pivoted through a screw 313, the female movable seat 31 and the male movable seat 32 can be rotated relatively from 0° to 180°, such that the handrail 1 can be installed or adjusted according to the different angles of the railings.

Also, when the movable corner 3 is used during the installation, since one end of the female movable seat 31 and the male movable seat 32 provided with the latching projection boards 324 is a circular cannula 323, after the handrail units 11, 12 are inserted from the outside, the female movable seat 31 and the male movable seat 32 can be rotated horizontally or in the upright direction. Accordingly, it can be applied to uneven slopes, providing the installation angle of handrail 1 with more flexibility.

Figure 6:
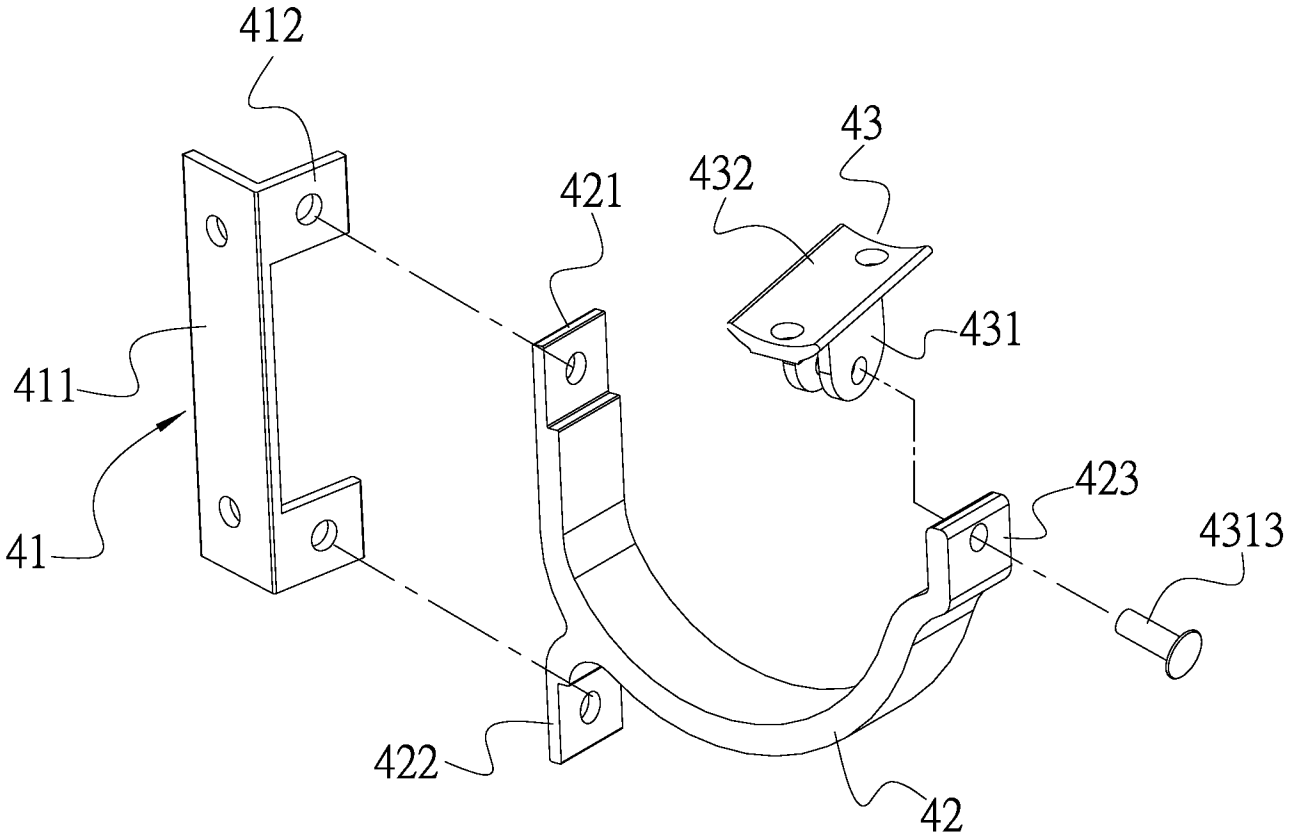
FIG. 6 is an exploded perspective view showing a support frame of the handrail and railing assembly in the present invention.

Please refer to FIG. 6. There are a plurality of support frames 4, which are installed at the bottom of the handrail 1 at intervals for stable support of the handrail 1. As shown, the support frame 4 includes: a holder 41, a U-shaped seat 42 and a bracket 43. A first plate 411 and a second plate 412 of the holder 41 are connected at a right angle and bent. The first plate 411 may be screwed to a post 201 or a thin tube 202 of the rail 200 (as shown in FIG. 1). The upper and lower ends of the second plate 412 are provided with through holes for the U-shaped seat 42 to be connected thereto and fixed.

As shown, one side of the U-shaped seat 42 is provided with a first connecting plate 421 extending upwardly and a second connecting plate 422 extending downward, respectively. The first connecting plate 421 and the second connecting plate 422 are provided with through holes respectively, such that it can be screwed to the second plate 412 of the holder 41. The opposite end of the U-shaped seat 42 is provided with a third connection plate 423 extending upwardly. The third connection plate 423 is provided with through holes for connection of the bracket 43.

As shown, the bracket 43 includes a locking portion 431 and a receiving portion 432. The locking portion 431 is provided with two mutually spaced locking plates 4311, 4312 mounted to the third connection plate 423 of the U-shaped seat 42 by a screw 4313. The receiving portion 432 is a horizontal pallet whose upper surface forms an arcuate surface in the axial direction to provide the placement of the handrail 1. A through hole is provided on the surface such that the handrail 1 can be locked fixedly thereon by a screw thereon. Since the locking plates 4311, 4312 of the bracket 43 are connected to the third connection plate 423 of the U-shaped seat 42 to rotate properly in the axial direction, after the installation of the handrail 1, its angle can be adjusted slightly according to on-site environment.

Figure 7:
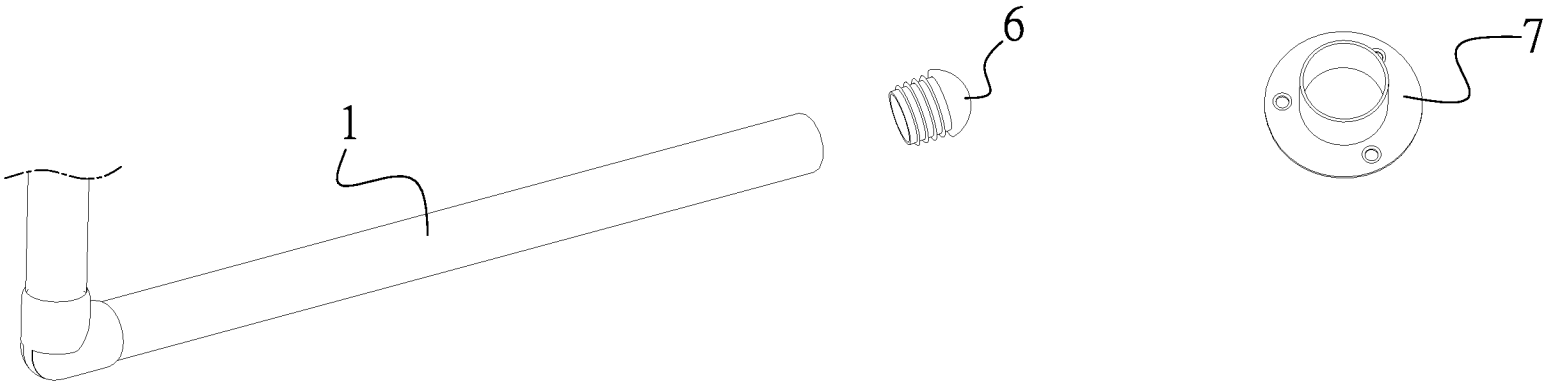
FIG. 7 is a perspective view showing an end cap and a wall-connecting base of the handrail and railing assembly in the present invention.

When the handrail and railing assembly in the present invention is implemented, the handrail 1 may be made of lightweight aluminum alloy. As shown in FIG. 7, an end cap 6 can be disposed at the beginning and end of the handrail 1 (please also refer to FIG. 1), to prevent rainwater from entering the inside of handrail 1, causing handrail 1 to corrode. Alternatively, in the implementation, a wall-connecting base 7 can be disposed at the beginning and end of the handrail 1 respectively (please also refer to FIG. 1), for sealing and beautification.

Therefore, compared with the existing technology, the handrail and railing assembly in the present invention has the following effects:

1) In the handrail and railing assembly, the support frame uses the U-shaped seat, and adjusts the position and the number of intervals installed according to the force strength of handrail to meet the strength requirements of different occasions; and adjust the installation angle according to on-site environmental needs;
2) In the handrail and railing assembly, the movable corner is connected to two adjacent handrail units, such that the connection between the two handrail units is smoother and installation is easier;
3) In the handrail and railing assembly, the connecting sleeve is connected to the handrail units, which not only facilitates the connection between the two adjacent handrail units, but saves the space required for packaging, shipping and assembling;

4) In the handrail and railing assembly, a base can be selectively mounted at the beginning or end of the handrail, e.g. on the railing column, the ground or the walls, providing a sealing and beautifying effect.

As above, the handrail and railing assembly in the present invention certainly has an unprecedented innovative structure, which is not found in any publication. Also, there are no similar products in the market. Therefore, it possesses novelty undoubtedly. In addition, the present invention has unique features and functionality far from the others in the art. It is indeed more inventive than the others in the art, and meets the requirements of the application requirements of the new patent law. Accordingly, the patent application has been filed in accordance with patent law.

It should be noted that the described are preferred embodiments. However, the structural features of the present invention are not limited thereto, and changes and modifications may be made to the described embodiments without departing from the scope of the invention as disposed by the appended claims.

What is claimed is:

1. A handrail and railing assembly, comprising:

a handrail, which is constructed by connection of a plurality of handrail units; each of the handrail units is connected with each other through a connecting sleeve;

a movable corner, which is located at the corner of the handrail, such that the handrail units being able to rotate relative to each other, the movable corner being made up of a female movable seat and a male movable seat assembled to rotate relative to each other so that the handrail being able to bend at various angles; and a plurality of support frames, which are mounted at intervals for supporting the handrail; the support frames being made up of a holder, a U-shaped seat and a bracket whose angle can be adjusted, the holder being fixed to the railing, one end of the U-shaped seat being connected to the holder, an opposite end of the U-shaped seat being connected to the bracket; the handrail can be placed above the bracket;

wherein the outer surface of the sleeve body is provided with a bump, as well as a collar, the inside of the collar is provided with a rib, the rib having a larger gap than the bump, such that the collar can adjust its position on the sleeve body depending on whether the gap on the rib is in communication with the bump.

2. The handrail and railing assembly as claimed in claim 1, wherein one end of the female movable seat of the movable corner is provided with a lateral kerf, a radial through hole is provided relative to above the lateral kerf, for locking into a screw bolt; an opposite end of the female movable seat is a cannula, and a plurality of spaced latching projection boards being provided along the inside of the cannula; one end of the male movable seat being provided with a plug portion which is a thin plate that can be inserted inside the kerf of the female movable seat, the surface of the plug portion being provided with a through hole, when being inserted into the inside of the kerf of the female movable seat, the through hole being in communication with the radial through hole of the female movable seat, that is, by the screw bolt passing through the through hole and the radial through hole, the female movable seat and male movable seat being assembled and rotated relatively.

3. The handrail and railing assembly as claimed in claim 2, wherein an opposite end of the male movable seat is a cannula, a plurality of spaced latching projection boards being provided along the inside of each cannula, an interspace existing between the latching projection boards and each cannula, such that when the handrail units are sleeved from the outside to the interspace, they are located between the latching projection boards and cannulas, whereby the handrail units can be held and fixed by the elasticity of the latching projection board to rotate properly.

4. The handrail and railing assembly as claimed in claim 2, wherein an opposite end of the male movable seat is a cannula, a plurality of spaced latching projection boards being provided inside each cannula, an interspace existing between the latching projection boards and each cannula, such that when the handrail units are sleeved from the outside to the interspace, they are located between the latching projection boards and the cannulas, whereby the handrail units can be held and fixed by the elasticity of the latching projection boards to rotate properly.

* * * * *